US006852672B2

(12) United States Patent
Tomita et al.

(10) Patent No.: US 6,852,672 B2
(45) Date of Patent: Feb. 8, 2005

(54) DYE-RECEPTIVE LAYER TRANSFER SHEET

(75) Inventors: Hirofumi Tomita, Shinjuku-Ku (JP); Kazuya Yoshida, Shinjuku-Ku (JP)

(73) Assignee: Dai Nippon Printing Co., Ltd. (JP)

( * ) Notice: Subject to any disclaimer, the term of this patent is extended or adjusted under 35 U.S.C. 154(b) by 135 days.

(21) Appl. No.: 10/282,060

(22) Filed: Oct. 29, 2002

(65) Prior Publication Data

US 2003/0092573 A1 May 15, 2003

(30) Foreign Application Priority Data

Oct. 29, 2001 (JP) ..... 2001-330144

(51) Int. Cl.[7] ..... B41M 5/035; B41M 5/38
(52) U.S. Cl. ..... 503/227; 428/32.51
(58) Field of Search ..... 8/471; 428/32.51; 503/227

(56) References Cited

U.S. PATENT DOCUMENTS 4,806,422 A 2/1989 Ohno et al. ..... 428/336
4,840,848 A 6/1989 Koshizuka et al. ..... 428/413
6,692,879 B2 * 2/2004 Suzuki et al. ..... 430/17

* cited by examiner

*Primary Examiner*—B. Hamilton Hess

(74) *Attorney, Agent, or Firm*—Parkhurst & Wendel, L.L.P.

(57) ABSTRACT

The present invention is directed to a dye-receptive layer transfer sheet which has a good balance between the adhesion to an object, on which a sublimation transferred image is to be formed, and the releasability of a print from a thermal transfer sheet having a dye layer at the time of printing of an image, using the thermal transfer sheet, on the object with a dye-receptive layer transferred thereon from the dye-receptive layer transfer sheet. The dye-receptive layer transfer sheet comprises: a substrate sheet; and a transferable dye-receptive layer provided separably on one side of the substrate sheet, the transferable dye-receptive layer comprising an epoxy-modified silicone, a methylstyrene-modified silicone, and a polyether-modified silicone.

4 Claims, No Drawings

DYE-RECEPTIVE LAYER TRANSFER SHEET

TECHNICAL FIELD

The present invention relates to a dye-receptive layer transfer sheet comprising a substrate sheet and a transferable dye-receptive layer provided separably on one side of the substrate sheet and more particularly to a dye-receptive layer transfer sheet which can realize high adhesion of a transferred dye-receptive layer to an object upon the transfer of the dye-receptive layer from the dye-receptive layer transfer sheet onto the object and can realize good releasability of a print from a thermal transfer sheet comprising a dye layer provided on a substrate at the time of printing of an image, using the thermal transfer sheet, on the object with the dye-receptive layer transferred thereon from the dye-receptive layer transfer sheet.

BACKGROUND OF THE INVENTION

Various thermal transfer recording methods are known in the art. Among them, a thermal dye sublimation transfer recording method is utilized as information recording means in various fields. In the thermal dye sublimation transfer recording method, a thermal transfer sheet comprising a dye layer containing a sublimable dye provided on a support such as a polyester film is heated by a heating medium such as a thermal head or a laser beam to form a dye image on an object. According to this method, a large number of color dots of three or four colors can be transferred by heating in a very short time onto an object, on which an image is to be recorded, to reproduce a full color image of an original. Further, since the formed image is very sharp and highly transparent, the reproduction of intermediate colors and the gradation are excellent and, thus, high-quality images comparable to the quality of full-color photographic images can be formed.

In the above method, however, objects, on which an image can be formed, are disadvantageously limited to dyeable plastic sheets or objects on which a dye-receptive layer colorable with a dye has been previously provided, and an image cannot be directly formed, for example, on metal plates or glasses, not to mention on ordinary paper.

In order to solve this problem, a receptive layer transfer sheet for the formation of a dye-receptive layer on an object has been used. In this dye-receptive layer transfer sheet, a dye-receptive layer is provided separably on a substrate, and a desired region of the dye-receptive layer transfer sheet is heated by a thermal head or the like from the backside of the sheet to transfer the dye-receptive layer onto an object in its necessary area only. A dye image can be formed on the object with the dye-receptive layer formed thereon.

In the receptive layer used in a dye-receptive layer transfer sheet in conventional thermal dye sublimation transfer materials, it is difficult to simultaneously realize both the adhesion of the dye-receptive layer onto the object and the releasability of a print from a thermal transfer sheet having a dye layer at the time of printing of an image, using the thermal transfer sheet, on the object with the dye-receptive layer transferred thereon from the dye-receptive layer transfer sheet. At the present time, importance is attached to ensure satisfactory adhesion, and, consequently, the releasability is disadvantageously unsatisfactory.

In order to ensure the releasability of the surface portion of the dye-receptive layer which has been transferred onto the object, a release agent (a silicone) should be localized around the interface of separation of the dye-receptive layer. In general, however, in the preparation of the dye-receptive layer transfer sheet, the release agent is localized at the interface of the dye receptive layer and the adhesive layer, which interface is opposite to the interface of separation of the dye-receptive layer.

When the amount of the silicone added is small, the adhesion of the dye-receptive layer to the object is ensured, but on the other hand, the releasability of a print from a thermal transfer sheet having a dye layer upon printing of an image, using the thermal transfer sheet, on the object with the receptive layer which has been transferred thereon from the dye-receptive layer transfer sheet is unsatisfactory. On the other hand, when the amount of silicone added is large, the adhesion of the transferred dye-receptive layer to the object cannot be ensured although the releasability at the time of printing can be developed. In order to ensure the adhesion of the adhesive layer overlying the dye-receptive layer in the dye-receptive layer transfer sheet, the amount of silicone added to the dye-receptive layer should be limited. This poses a problem that, at the time of printing using a thermal transfer sheet having a dye layer, the separability of the print from the thermal transfer sheet is unsatisfactory.

Accordingly, the realization of a transferable dye-receptive layer, which can realize the regulation of the state of presence of a release agent typified by silicones in the dye-receptive layer to provide satisfactory releasability from a thermal transfer sheet having a dye layer and adhesion to an object, has been desired.

Further, in the prior art technique, due to unsatisfactory adhesion of the receptive layer, which has been transferred onto an object, to the object, folding and/or heat expansion or contraction of the object in the image formed object have disadvantageously resulted in the separation of the receptive layer or breaking of the formed image. Under the above circumstances, the preparation of image formed objects (prints), which have high-density and high-definition photograph-like full-color images and possess excellent thermal properties, in an on-demand manner has been desired.

DISCLOSURE OF THE INVENTION

The present invention has been made with a view to solving the above problems of the prior art, and it is an object of the present invention to provide a dye-receptive layer transfer sheet which can realize a good balance between the adhesion to an object, on which a sublimation transferred image is to be formed, and the releasability of a print from a thermal transfer sheet having a dye layer at the time of printing of an image, using the thermal transfer sheet, on the object with a dye-receptive layer transferred thereon from the dye-receptive layer transfer sheet.

The above object can be attained by a dye-receptive layer transfer sheet comprising: a substrate sheet; and a transferable dye-receptive layer provided separably on one side of the substrate sheet, the transferable dye-receptive layer comprising an epoxy-modified silicone, a methylstyrene-modified silicone, and a polyether-modified silicone.

In a preferred embodiment of the present invention, the transferable dye-receptive layer comprises, based on the resin component of the transferable dye-receptive layer, 3 to 15% by weight of the epoxy-modified silicone, 3 to 15% by weight of the methylstyrene-modified silicone, and 3 to 15% by weight of the polyether-modified silicone.

In another preferred embodiment of the present invention, a heat-resistant slip layer is provided on the surface of the substrate sheet remote from the transferable dye-receptive layer.

Further, according to the present invention, there is provided an image formation method comprising the steps of: providing a transfer substrate sheet having a tensile strength (ASTM-D638) of 10 to 120 MPa, a coefficient of linear expansion (ASTM-D696) of $3\times10^{-5}$ to $20\times10^{-5}$ cm/cm·° C., and a heat distortion temperature (ASTM-D648) of 35 to 200° C.; thermally transferring the above thermally transferable dye-receptive layer on the transfer substrate sheet through an adhesive layer; forming a sublimation transferred image on the transferred dye-receptive layer; and stacking a protective layer by thermal transfer onto the sublimation transferred image on the dye-receptive layer. According to the present inventor's finding, the preparation of prints by the above method can effectively prevent the separation of the receptive layer and the breaking of the images upon folding or thermal expansion and contraction of the sheet.

According to the present invention, the proper selection of the types and addition amounts of silicones added to the transferable dye-receptive layer used in the dye-receptive layer transfer sheet can realize the regulation of the state of presence of the release agent (modified silicones) in the dye-receptive layer so that the release agent (modified silicones) is localized around the interface of separation of the dye-receptive layer in the dye-receptive layer transfer sheet to provide satisfactory releasability at the time of printing, that is, satisfactory releasability of the transferable dye-receptive layer in its surface portion from a thermal transfer sheet having a dye layer after the transfer of the dye layer, and good adhesion of the receptive layer to an object after the transfer of the receptive layer.

BEST MODE FOR CARRYING OUT THE INVENTION

Preferred embodiments of the present invention will be described in more detail.

The dye-receptive layer transfer sheet according to the present invention comprises: a substrate sheet; and a transferable dye-receptive layer provided separably on one side of the substrate sheet, the transferable dye-receptive layer comprising an epoxy-modified silicone, a methylstyrene-modified silicone, and a polyether-modified silicone.

(Substrate Sheet)

In the dye-receptive layer transfer sheet according to the present invention, a dye-receptive layer is provided separably on the substrate sheet. The substrate sheet functions to hold the receptive layer. Further, since the substrate sheet is heated at the time of thermal transfer, the substrate sheet preferably has mechanical strength on a level such that, even in a heated state, the substrate sheet can be handled without any trouble. The substrate sheet may be in a sheet form having a desired size or alternatively may be in the form of a continuous film. Materials for such substrate sheets are not particularly limited, and the same substrate material as used in the substrate sheet in the conventional thermal transfer sheet as such may be used.

Examples of substrate sheets usable herein include: tissue papers, such as capacitor paper, glassine paper, and paraffin paper; and films of polyester, polyacrylate, polycarbonate, polyurethane, polyimide, polyetherimide, cellulose derivatives, polyethylene, ethylene-vinyl acetate copolymer, polypropylene, polystyrene, acrylic polymer, polyvinyl chloride, polyvinylidene chloride, polyvinyl alcohol, polyvinyl butyral, nylon, polyetherether ketone, polysulfone, polyethersulfone, tetrafluoroethylene-perfluoroalkyl vinyl ether, polyvinyl fluoride, tetrafluoroethylene-ethylene, tetrafluoroethylene-hexafluoropropylene, polychlorotrifluoroethylene, polyvinylidene fluoride and the like. Laminates of the synthetic resins and the papers may also be used.

The thickness of the substrate sheet may be properly varied depending upon materials for the substrate sheet so that the substrate sheet has proper strength, heat resistance and other properties. Preferably, however, the thickness is about 2 to 100 $\mu$m.

(Release Layer)

Before the formation of the dye-receptive layer on the substrate sheet, a release layer may be formed on the substrate sheet from the viewpoint of improving the separability of the dye-receptive layer from the substrate sheet.

The release layer may be formed of a resin having a relatively high softening point which is not melted upon exposure to the heat of a thermal head, for example, a silicone-modified acrylic resin, a cellulosic resin, an acrylic resin, a polyurethane resin, a polyvinyl acetal resin, or any one of the above resins in which a hot release agent such as wax has been incorporated. The release layer may be formed by coating a coating liquid containing the above resin by formation means, such as gravure printing, screen printing, or reverse roll coating using a gravure plate, and drying the coating. A coverage of about 0.5 to 5 g/m$^2$ on a dry basis suffices for the receptive layer. When it is preferred that the transferred dye-receptive layer be matte, the surface of the dye-receptive layer can be made matte by incorporating various particles in the release layer or by subjecting the release layer on its dye-receptive layer side to matting treatment.

(Dye-Receptive Layer)

In the dye-receptive layer transfer sheet according to the present invention, the dye-receptive layer provided separably on the substrate sheet is transferred onto a desired object, and the transferred dye-receptive layer receives a sublimable dye transferred from a thermal transfer sheet and holds the formed image thereon. Examples of resins usable for the formation of the dye-receptive layer include: polyolefin resins such as polypropylene; halogenated polymers such as polyvinyl chloride, vinyl chloride-vinyl acetate copolymer, and polyvinylidene chloride; vinyl polymers such as polyvinyl acetate, ethylene-vinyl acetate copolymer, and polyacrylic esters; polyester resins such as polyethylene terephthalate and polybutylene terephthalate; polystyrene resins; polyamide resins; copolymer resins produced from olefins, such as ethylene and propylene, and other vinyl monomers; ionomers; cellulosic resins such as cellulose diacetate; polycarbonate resins; polyvinyl acetal resins; and polyvinyl alcohol resins. Particularly preferred are vinyl resins and polyester resins.

The dye-receptive layer contains, as a release agent, a combination of three modified silicones, an epoxy-modified silicone, a methylstyrene-modified silicone, and a polyether-modified silicone.

While the incorporation of a release agent comprising two modified silicones, i.e., an epoxy-modified silicone and a methylstyrene-modified silicone, in the dye-receptive layer did not simultaneously satisfy both the adhesion of the transferred dye-receptive layer to an object, on which a sublimation transferred image is to be formed, and releasability of a print from a thermal transfer sheet having a dye layer at the time of printing of an image, using the thermal transfer sheet, on the object with the dye-receptive layer transferred thereon from the dye-receptive layer transfer sheet, the addition of the three modified silicones, i.e., a polyether-modified silicone in addition to the above two modified silicones, respectively in specified amounts to the dye-receptive layer could have realized the regulation of the state of presence of the release agent (a state such that the release agent has been bled) on the surface of the dye-receptive layer and could have realized the localization of the release agent (modified silicones) around the interface of separation of the dye-receptive layer in the dye-receptive layer transfer sheet. As a result, both properties, i.e., the adhesion of the dye-receptive layer transfer sheet to an object, and the releasability of a print from a thermal transfer sheet upon printing of an image, using the thermal transfer sheet, on the dye-receptive layer transferred onto the object could be simultaneously realized, although the reason why the use of a combination of the three modified silicones can simultaneously satisfy both the desired properties has not been elucidated.

The three modified silicones are preferably contained in the dye-receptive layer in respective amounts, based on the resin component constituting the dye-receptive layer, of 3 to 15% by weight (epoxy-modified silicone), 3 to 15% by weight (methylstyrene-modified silicone), and 3 to 15% by weight (polyether-modified silicone).

Pigments or fillers, such as titanium oxide, zinc oxide, kaolin clay, calcium carbonate, and finely divided silica powder, may be added to the receptive layer from the viewpoint of improving the whiteness of the dye-receptive layer to further enhance the sharpness of the transferred image.

The dye-receptive layer may be formed by adding a combination of the three release agents, i.e., an epoxy-modified silicone, a methylstyrene-modified silicone, and a polyether-modified silicone, and optional other additives to the resin for constituting the dye-receptive layer, dissolving the mixture in a suitable organic solvent or dispersing the mixture in an organic solvent or water, coating the solution or the dispersion by formation means, for example, gravure printing, screen printing, or reverse roll coating using a gravure plate, and drying the coating. The dye-receptive layer may have any thickness. In general, however, the thickness of the dye-receptive layer is 1 to 50 g/m$^2$ on a dry basis. The dye-receptive layer is preferably a continuous coating. Alternatively, the dye-receptive layer may be formed as a discontinuous coating using a resin emulsion or a resin dispersion.

(Adhesive Layer)

In the dye-receptive layer transfer sheet according to the present invention, preferably, an adhesive layer is provided on the surface of the transferable dye-receptive layer from the viewpoint of improving the transferability of the transferable dye-receptive layer. The adhesive layer may be formed of a conventional pressure-sensitive adhesive or a heat-sensitive adhesive. More preferably, however, the adhesive layer is formed of a thermoplastic resin having a glass transition temperature of 50 to 80° C. A thermoplastic resin having a suitable glass transition temperature is preferably selected from resins having good adhesion in heated state, for example, polyester resins, vinyl chloride-vinyl acetate copolymer resins, acrylic resins, ultraviolet absorbing resins, butyral resins, epoxy resins, polyamide resins, and vinyl chloride resins. In particular, the adhesive layer preferably contains at least one of polyester resins, vinyl chloride-vinyl acetate copolymer resins, acrylic resins, ultraviolet absorbing resins, butyral resins, and epoxy resins. From the viewpoint of adhesion and when the adhesive layer is formed as a pattern on a part, rather than over the whole area, of the surface of the transferable dye-receptive layer by means of heating means such as a thermal head, preferably, the above resin has a small molecular weight. The adhesive layer may contain a white pigment, a brightening agent and/or a blowing or foaming agent.

The ultraviolet absorbing resin may be a resin produced by chemically bonding a reactive ultraviolet absorber to a thermoplastic resin or an ionizing radiation-curable resin. Specific examples of reactive ultraviolet absorbers include compounds produced by introducing a reactive group, for example, an addition-polymerizable double bond, such as a vinyl or acryloyl group or a methacryloyl group, or an alcoholic hydroxyl, amino, carboxyl, epoxy, isocyanate or other group, into conventional nonreactive organic ultraviolet absorbers, such as salicylate, phenyl acrylate, benzophenone, benzotriazole, cumarine, triazine, or nickel chelate nonreactive organic ultraviolet absorbers. The adhesive layer may be formed by coating a coating liquid containing the resin for constituting the adhesive layer and optional additives, such as inorganic or organic fillers, and drying the coating. The coverage of the adhesive layer is preferably about 0.5 to 10 g/m$^2$ on a dry basis.

(Heat-Resistant Slip Layer)

In the dye-receptive layer transfer sheet according to the present invention, a heat-resistant slip layer may be provided on the backside of the substrate sheet, that is, on the substrate sheet in its side remote from the transferable dye-receptive layer, from the viewpoint of avoiding adverse effects, such as sticking or cockling caused by heat from the thermal head. Any conventional resin may be used as the resin for the formation of the heat-resistant slip layer, and examples thereof include polyvinylbutyral resins, polyvinylacetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, urethane or epoxy prepolymers, nitrocellulose resins, cellulose nitrate resins, cellulose acetopropionate resins, cellulose acetate butyrate resins, cellulose acetate hydrogenphthalate resins, cellulose acetate resins, aromatic polyamide resins, polyimide resins, polycarbonate resins, and chlorinated polyolefin resins.

Slip property-imparting agents added to or coated onto the heat-resistant slip layer formed of the above resin include phosphoric esters, silicone oils, graphite powders, silicone graft polymers, fluoro graft polymers, acrylic silicone graft polymers, acrylsiloxanes, arylsiloxanes, and other silicone polymers. Preferably, the heat-resistant slip layer is formed of a polyol, for example, a polyalcohol polymer compound, a polyisocyanate compound, or a phosphoric ester compound. Further, the addition of a filler is more preferred. The heat-resistant slip layer may be formed by dissolving or dispersing the above resin, slip property-imparting agent, and filler in a suitable solvent to prepare an ink for a heat-resistant slip layer, coating the ink onto the backside of the substrate sheet by formation means, such as gravure printing, screen printing, or reverse coating using a gravure plate, and drying the coating. The coverage of the heat-resistant slip layer is about 0.1 to 2.0 g/m$^2$ on a dry basis.

Further, the present invention includes an image formation method comprising the steps of: providing a transfer substrate sheet having a tensile strength (ASTM-D638) of 10 to 120 MPa, a coefficient of linear expansion (ASTM-D696) of $3\times10^{-5}$ to $20\times10^{-5}$ cm/cm·° C., and a heat distortion temperature (ASTM-D648) of 35 to 200° C.; thermally transferring the above thermally transferable dye-receptive layer on the transfer substrate sheet through an adhesive layer; forming a sublimation transferred image on the transferred dye-receptive layer; and stacking a protective layer by thermal transfer onto the sublimation transferred image on the dye-receptive layer. According to the present inventor's finding, the preparation of prints by the above method can effectively prevent the separation of the receptive layer and the breaking of the images upon folding or thermal expansion and contraction of the sheet.

EXAMPLES

The following examples and comparative examples further illustrate the present invention. In the following description, "part(s)" or "%" is by weight.

Example 1

A coating liquid for a heat-resistant slip layer having the following composition was coated onto the surface of a 4.5 μm-thick polyethylene terephthalate film manufactured by Toray Industries, Inc. by means of a bar coater at a coverage of 0.5 g/m$^2$ on a dry basis, and the coating was predried by means of a drier and was then dried in an oven of 100° C. for 30 min to form a heat-resistant slip layer.

| [Composition of coating liquid for heat-resistant slip layer] | |
|---|---|
| Curable silicone oil (KS-770 A, manufactured by Shin-Etsu Chemical Co., Ltd.) | 100 parts |
| Curing catalyst (CAT-PL 8, manufactured by Shin-Etsu Chemical Co., Ltd.) | 1 part |
| Toluene | 400 parts |

Next, a release layer, a dye-receptive layer, and an adhesive layer were formed using the following respective coating liquids in that order on the surface of the polyethylene terephthalate film remote from the heat-resistant slip layer to prepare a dye-receptive layer transfer sheet of Example 1.

Specifically, the release layer was formed by coating a coating liquid for a release layer having the following composition onto the surface of the polyethylene terephthalate film remote from the heat-resistant slip layer by means of a bar coater at a coverage of 0.5 g/m$^2$ on a dry basis, predrying the coating by means of a drier, and then drying the predried coating in an oven of 100° C. for 30 min.

| [Composition of coating liquid for release layer] | |
|---|---|
| Silicone-modified acrylic resin (CELTOP 226, manufactured by Daicel Chemical Industries, Ltd.) | 16 parts |
| Aluminum catalyst (CELTOP AT-A, manufactured by Daicel Chemical Industries, Ltd.) | 3 parts |
| Methyl ethyl ketone/toluene (weight ratio = 1/1) | 16 parts |

The dye-receptive layer was formed by coating a coating liquid for a dye-receptive layer having the following composition onto the release layer by means of a bar coater at a coverage of 3.0 g/m$^2$ on a dry basis, predrying the coating by means of a drier, and then drying the predried coating in an oven of 100° C. for 30 min. The adhesive layer was formed by coating a coating liquid for an adhesive layer having the following composition onto the dye-receptive layer by means of a bar coater at a coverage of 2.0 g/m$^2$ on a dry basis, predrying the coating by means of a drier, and then drying the predried coating in an oven of 100° C. for 30 min.

| [Composition of coating liquid for dye-receptive layer] | |
|---|---|
| Vinyl chloride-vinyl acetate copolymer (1000 A, manufactured by Denki Kagaku Kogyo K.K.) | 100 parts |

-continued

| | |
|---|---|
| Epoxy-modified silicone (X-22-3000 T, manufactured by Shin-Etsu Chemical Co., Ltd.) | 7.5 parts |
| Metylstyrene-modified silicone (X-24-510, manufactured by Shin-Etsu Chemical Co., Ltd.) | 7.5 parts |
| Polyether-modified silicone (FZ 2101, manufactured by Nippon Unicar Co., Ltd.) | 5 parts |
| Methyl ethyl ketone/toluene (weight ratio = 1/1) | 400 parts |
| [Composition of coating liquid for adhesive layer] | |
| Polyester resin (UE 3201, manufactured by Unitika Ltd.) | 100 parts |
| Methyl ethyl ketone/toluene (weight ratio = 1/1) | 300 parts |
| Silica (antiblocking agent) | 0.1 part |

Comparative Example 1

A dye-receptive layer transfer sheet of Comparative Example 1 was prepared in the same manner as in Example 1, except that the coating liquid for a dye-receptive layer in Example 1 was changed to a coating liquid for a dye-receptive layer having the following composition.

| [Composition of coating liquid for dye-receptive layer] | |
|---|---|
| Vinyl chloride-vinyl acetate copolymer (1000 A, manufactured by Denki Kagaku Kogyo K.K.) | 100 parts |
| Epoxy-modified silicone (X-22-3000 T, manufactured by Shin-Etsu Chemical Co., Ltd.) | 20 parts |
| Methyl ethyl ketone/toluene (weight ratio = 1/1) | 400 parts |

Comparative Example 2

A dye-receptive layer transfer sheet of Comparative Example 2 was prepared in the same manner as in Example 1, except that the coating liquid for a dye-receptive layer in Example 1 was changed to a coating liquid for a dye-receptive layer having the following composition.

| [Composition of coating liquid for dye-receptive layer] | |
|---|---|
| Vinyl chloride-vinyl acetate copolymer (1000 A, manufactured by Denki Kagaku Kogyo K.K.) | 100 parts |
| Methylstyrene-modified silicone (X-24-510, manufactured by Shin-Etsu Chemical Co., Ltd.) | 20 parts |
| Methyl ethyl ketone/toluene (weight ratio = 1/1) | 400 parts |

Comparative Example 3

A dye-receptive layer transfer sheet of Comparative Example 3 was prepared in the same manner as in Example 1, except that the coating liquid for a dye-receptive layer in Example 1 was changed to a coating liquid for a dye-receptive layer having the following composition.

| [Composition of coating liquid for dye-receptive layer] | |
|---|---|
| Vinyl chloride-vinyl acetate copolymer (1000 A, manufactured by Denki Kagaku Kogyo K.K.) | 100 parts |
| Polyether-modified silicone (FZ 2101, manufactured by Nippon Unicar Co., Ltd.) | 20 parts |
| Methyl ethyl ketone/toluene (weight ratio = 1/1) | 400 parts |

Comparative Example 4

A dye-receptive layer transfer sheet of Comparative Example 4 was prepared in the same manner as in Example 1, except that the coating liquid for a dye-receptive layer in Example 1 was changed to a coating liquid for a dye-receptive layer having the following composition.

| [Composition of coating liquid for dye-receptive layer] | |
|---|---|
| Vinyl chloride-vinyl acetate copolymer (1000 A, manufactured by Denki Kagaku Kogyo K.K.) | 100 parts |
| Epoxy-modified silicone (X-22-3000 T, manufactured by Shin-Etsu Chemical Co., Ltd.) | 2 parts |
| Metylstyrene-modified silicone (X-24-510, manufactured by Shin-Etsu Chemical Co., Ltd.) | 2 parts |
| Polyether-modified silicone (FZ 2101, manufactured by Nippon Unicar Co., Ltd.) | 2 parts |
| Methyl ethyl ketone/toluene (weight ratio = 1/1) | 400 parts |

Comparative Example 5

A dye-receptive layer transfer sheet of Comparative Example 5 was prepared in the same manner as in Example 1, except that the coating liquid for a dye-receptive layer in Example 1 was changed to a coating liquid for a dye-receptive layer having the following composition.

| [Composition of coating liquid for dye-receptive layer] | |
|---|---|
| Vinyl chloride-vinyl acetate copolymer (1000 A, manufactured by Denki Kagaku Kogyo K.K.) | 100 parts |
| Epoxy-modified silicone (X-22-3000 T, manufactured by Shin-Etsu Chemical Co., Ltd.) | 16 parts |
| Metylstyrene-modified silicone (X-24-510, manufactured by Shin-Etsu Chemical Co., Ltd.) | 16 parts |
| Polyether-modified silicone (FZ 2101, manufactured by Nippon Unicar Co., Ltd.) | 16 parts |
| Methyl ethyl ketone/toluene (weight ratio = 1/1) | 400 parts |

Each of the dye-receptive layer transfer sheets prepared in Example 1 and Comparative Examples 1 to 5 was put on top of an object (an acrylic resin sheet (thickness 150 μm) not colorable with a dye) so that the transferable dye-receptive layer in the dye-receptive layer transfer sheet faced the object, followed by the transfer of the transferable dye-receptive layer onto the object under the following conditions. The object with the dye-receptive layer transferred thereon (image-receiving object) was then put on top of a thermal transfer sheet comprising a substrate and dye layers provided on the substrate (a transfer film PK 700 L for a video printer CP-700, manufactured by Mitsubishi Petrochemical Co., Ltd.) so that the dye layers faced the dye-receptive surface. The assembly was heated from the backside of the thermal transfer sheet by means of a thermal head under the following conditions to perform thermal transfer recording in the order of Y, M, and C to form a gradation image of gray.

(Conditions for Transfer of Receptive Layer Onto Object)

Thermal head: KGT-217-12 MPL 20, manufactured by Kyocera Corp.

Average resistance value of heating element: 3195 Ω

Print density in scanning direction: 300 dpi

Print density in feed direction: 300 dpi

Applied power: 0.12 w/dot

One line period: 5 msec

Printing initiation temp.: 40° C.

Applied pulse: A multipulse-type test printer was used wherein the number of divided pulses with a pulse length obtained by equally dividing one line period into 256 parts is variable from 0 to 255 during one line period. In this case, the duty ratio for each divided pulse was fixed to 60%, and the number of pulses per line period was fixed to 255.

(Conditions for Printing of Gradation Images of Gray)

Thermal head: KGT-217-12 MPL 20, manufactured by Kyocera Corp.

Average resistance value of heating element: 3195 Ω

Print density in scanning direction: 300 dpi

Print density in feed direction: 300 dpi

Applied power: 0.12 w/dot

One line period: 5 msec

Printing initiation temp.: 40° C.

Gradation control method: A multipulse-type test printer was used wherein the number of divided pulses with a pulse length obtained by equally dividing one line period into 256 parts is variable from 0 to 255 during one line period. In this case, the duty ratio for each divided pulse was fixed to 60%, and, according to the gradation, the number of pulses per line period was brought to 0 for step 0, 17 for step 1, 34 for step 2 and the like. In this way, the number of pulses was successively increased from 0 to 255 by 17 for each step. Thus, 16 gradation steps from step 0 to step 15 were controlled to form a gradation image.

The objects with the dye-receptive layer transferred thereon and the image-received objects with the gradation image printed thereon were evaluated for the adhesion between the transferred receptive layer and the object as measured by a tape adhesion test and the releasability at the time of printing of gradation images.

(Adhesion Between Transferred Receptive Layer and Object as Measured by Tape Adhesion Test)

For each sample obtained by transferring the dye-receptive layer from each of the dye-receptive layer transfer sheets prepared under the above conditions onto the object, a cellophane pressure-sensitive adhesive tape was applied to the transferred receptive layer side by pressing the tape against the transferred receptive layer by a thumb by single reciprocation. Immediately after that, the tape was separated by a hand at a peel angle of 180 degrees, and the tape was then visually inspected for whether or not the layer on the receptive layer side was separated and transferred onto the tape side. The results were evaluated according to the following criteria.

○: No layer was separated and transferred onto the tape side, indicating that the adhesion was good.

X: The layer was separated and transferred onto the tape side, indicating that the adhesion was poor.

(Releasability at the Time of Printing)

At the time of printing of a gradation image formed by sublimation dye transfer on each of the objects with the dye-receptive layer transferred thereon prepared under the above conditions, the releasability of the dye layer in the thermal transfer sheet from the transferred receptive layer side of the object (for example, whether or not the dye layer can be separated from the transferred receptive layer side without difficulty and whether or not fusing between the dye layer and the transferred receptive layer side occurred) was visually inspected. The results were evaluated according to the following criteria.

○: The releasability was good.

Δ: Large force was necessary for the separation of the dye layer from the transferred receptive layer side although fusing between the dye layer and the transferred receptive layer side did not occur.

X: The dye layer was partially or entirely fused to the transferred receptive layer side, and abnormal transfer occurred.

(Results of Evaluation)

The results of evaluation are shown in Table 1 below.

TABLE 1

| | Adhesion between transferred receptive layer and object as measured by tape adhesion test | Releasability at the time of printing |
|---|---|---|
| Ex. 1 | ○ | ○ |
| Comp. Ex. 1 | X | ○ |
| Comp. Ex. 2 | ○ | Δ |
| Comp. Ex. 3 | ○ | X |
| Comp. Ex. 4 | ○ | X |
| Comp. Ex. 5 | X | ○ |

As is apparent from the above results, when the use of any one of the epoxy-modified silicone, the methylstyrene-modified silicone, and the polyether-modified silicone could not realize a combination of the adhesion of the receptive layer to the object upon the transfer of the receptive layer and the releasability of the print from the dye layer after the transfer. On the other hand, the addition of a blend of the three components, i.e., the epoxy-modified silicone, the methylstyrene-modified silicone, and the polyether-modified silicone, at a proper ratio simultaneously developed both the properties which could not have hitherto been simultaneously realized. The combined use of two modified silicones among the above three modified silicones could not simultaneously satisfy both the properties, i.e., the adhesion of the receptive layer to the object upon the transfer of the receptive layer and the releasability of the print from the dye layer after the transfer. This demonstrates that the addition of a combination of the three modified silicones is necessary for simultaneously satisfying both the desired properties.

In the case of the addition of the three modified silicones, when the amounts of the modified silicones added were excessively small, satisfactory releasability at the time of printing was not developed although the adhesion of the receptive layer to the object upon the transfer of the receptive layer was maintained. On the other hand, when the amounts of the three modified silicones added were excessively large, the adhesion of the receptive layer to the object upon the transfer of the receptive layer could not be maintained although the releasability at the time of printing could be developed.

Comparative Example 6

An image formed object was prepared in the same manner as in Example 1, except that a 150 μm-thick low-density polyethylene resin sheet having a tensile strength (ASTM-D638) of 8.5 MPa, a coefficient of linear expansion (ASTM-D696) of $2\times10^{-5}$ cm/cm·° C., and a heat distortion temperature (ASTM-D648) of 32° C. was used instead of the polyethylene terephthalate film in Example 1.

Comparative Example 7

An image formed object was prepared in the same manner as in Example 1, except that a 150 μm-thick glass fiber reinforced resin sheet having a tensile strength (ASTM-D638) of 150 MPa, a coefficient of linear expansion (ASTM-D696) of $2\times10^{-5}$ cm/cm·° C., and a heat distortion temperature (ASTM-D648) of 250° C. was used instead of the polyethylene terephthalate film in Example 1.

For the above comparative examples, the prints thus obtained were subjected to a folding test and a test on thermal expansion and contraction, and, in addition, a test on releasability at the time of printing was carried out. The results are shown in Table 2 below.

The folding test and the test on thermal expansion and contraction were carried out by the following methods.

(Folding Test)

An image formed object having a length of 10 cm and a width of 2.54 cm was provided as a specimen. The specimen was installed on a support base (front end R 9.5±0.2 mm) having a distance between supporting points of 5 cm so that the printed surface faced downward. A load was applied to the specimen by a pressure wedge having a front end R of 9.5±0.2 mm from above the center between the supporting points so that the center portion of the specimen was distorted by 10 mm. This load application was repeated ten times, and the surface of the print was then evaluated for transferability in the same manner as described above.

(Test on Thermal Expansion and Contraction)

An image formed object having a length of 10 cm and a width of 2.54 cm was provided as a specimen. A weight of 50 g was fixed to one end of the specimen, and the other end of the specimen was fixed to the ceiling. In this suspended state, the end with the weight fixed thereto was dipped in a thermostatic chamber set at 80° C. and was allowed to stand for 3 hr. The weight was then removed from the specimen, and the specimen was allowed to stand at room temperature (23° C.) for one hr. Thereafter, the surface of the print was evaluated for transferability in the same manner as described above.

TABLE 2

| | Folding test (1) | Test on thermal expansion and contraction (2) | Suitability for printing (3) |
|---|---|---|---|
| Comp. Ex. 6 | X | X | ○ |
| Comp. Ex. 7 | ○ | X | ○ |

Note)
(1) ○: not separated, X: separated
(2) ○: not separated, X: separated
(3) ○: good, X: unsatisfactory print quality (density or evenness)

In the dye-receptive layer transfer sheet comprising a substrate sheet and a transferable dye-receptive layer provided separably on one side of the substrate sheet, when the transferable dye-receptive layer contained an epoxy-modified silicone, a methylstyrene-modified silicone, and a polyether-modified silicone in respective amounts, based on the resin component, of 3 to 15% by weight (epoxy-modified silicone), 3 to 15% by weight (methylstyrene-modified silicone), and 3 to 15% by weight (polyether-modified silicone), the state of presence of the release agent (modified silicones) in the dye-receptive layer can be regulated so that the release agent (modified silicones) is localized around the interface of separation of the dye-receptive layer in the dye-receptive layer transfer sheet to provide satisfactory releasability at the time of printing, that is, satisfactory releasability of the transferable dye-receptive layer in its surface portion from a thermal transfer sheet having a dye layer after the transfer of the dye layer, and good adhesion of the receptive layer to an object after the transfer of the receptive layer.

What is claimed is:

1. A dye-receptive layer transfer sheet comprising:

a substrate sheet having first and second sides; and a transferable dye-receptive layer located on said first side of the substrate sheet, the transferable dye-receptive layer comprising an epoxy-modified silicone, a methylstyrefle-modified silicone, and a polyether-modified silicone.

2. The dye-receptive layer transfer sheet according to claim 1, wherein the transferable dye-receptive layer comprises, based on the resin component of the transferable dye-receptive layer, 3 to 15% by weight of the epoxy-modified silicone, 3 to 15% by weight of the methylstyrene-modified silicone, and 3 to 15% by weight of the polyether-modified silicone.

3. The dye-receptive layer transfer sheet according to claim 1, wherein a heat-resistant slip layer is located on the second side of the substrate sheet.

4. An image formation method comprising:

providing a transfer substrate sheet having a tensile strength (ASTM-D638) of 10 to 120 MPa, a coefficient of linear expansion (ASTN-D696) of $3\times10^{-5}$ to $20\times10^{-5}$ cm/cm° C., and a heat distortion temperature (ASTM-D648) of 35 to 200° C.;

thermally transferring a thermally transferable dye-receptive layer comprising an epoxy-modified silicone, a methyistyrene-modified silicone, and a polyether-modified silicone onto the transfer substrate sheet;

forming a sublimation transferred image on the transferred dye-receptive layer; and stacking a protective layer by thermal transfer onto the sublimation transferred image on the dye-receptive layer.

* * * * *